US008783896B2

(12) United States Patent
Tirrell et al.

(10) Patent No.: US 8,783,896 B2
(45) Date of Patent: Jul. 22, 2014

(54) PIVOTABLE RAIL ASSEMBLY FOR INSTALLING RECESSED LIGHTING FIXTURES

(75) Inventors: Charles Tirrell, Milford, NJ (US); Donald Leithauser, Jr., Perth Amboy, NJ (US); Christopher W. McQuillan, Marlton, NJ (US)

(73) Assignee: ABL IP Holding LLC, Conyers, GA (US)

( * ) Notice: Subject to any disclaimer, the term of this patent is extended or adjusted under 35 U.S.C. 154(b) by 528 days.

(21) Appl. No.: 12/915,957

(22) Filed: Oct. 29, 2010

(65) Prior Publication Data

US 2011/0103042 A1 May 5, 2011

Related U.S. Application Data

(60) Provisional application No. 61/256,022, filed on Oct. 29, 2009.

(51) Int. Cl.
*F21S 13/02* (2006.01)

(52) U.S. Cl.
USPC ..... 362/220; 362/285; 362/365; 362/427

(58) Field of Classification Search
USPC ..... 362/146–148, 362–368, 370–375, 362/427–439, 220, 269, 271, 285, 286
See application file for complete search history.

(56) References Cited

U.S. PATENT DOCUMENTS

| | | | | |
|---|---|---|---|---|
| 2,124,050 | A * | 7/1938 | Bruner | 362/472 |
| 3,778,609 | A * | 12/1973 | Liberman | 362/364 |
| 3,810,085 | A | 5/1974 | Woloski | |
| 5,081,566 | A * | 1/1992 | Crispin et al. | 362/147 |
| 5,124,902 | A * | 6/1992 | Puglisi | 362/386 |
| 5,289,358 | A * | 2/1994 | Halemeier | 362/365 |
| 5,564,815 | A * | 10/1996 | Littman et al. | 362/147 |
| 5,609,408 | A * | 3/1997 | Targetti | 362/523 |
| 6,059,424 | A * | 5/2000 | Kotloff | 362/220 |
| 6,102,550 | A | 8/2000 | Edwards, Jr. | |
| 6,517,216 | B1 * | 2/2003 | Cercone et al. | 362/220 |
| 7,686,466 | B2 * | 3/2010 | Lev et al. | 362/23 |
| 7,901,105 | B2 * | 3/2011 | Fowler et al. | 362/217.15 |
| 7,971,680 | B2 * | 7/2011 | Morgan et al. | 181/205 |

OTHER PUBLICATIONS

Office Action for Canadian Application No. CA 2,719,327 mailed Jul. 4, 2012 (3 pages).
Office Action for Canadian Application No. CA 2,719,327 mailed Jun. 20, 2013.
Columbia Lighting, ZPT24, 2'×4' Plenum® Troffer/2-Lamp T5, T5HO, www.columbialighting.com, Jul. 30, 2009 (2 pages).

* cited by examiner

*Primary Examiner* — Hargobind S Sawhney
(74) *Attorney, Agent, or Firm* — Kilpatrick Townsend & Stockton, LLP

(57) ABSTRACT

A lighting fixture for installation in a ceiling grid includes a lighting assembly and at least one pivotable rail assembly attached to the lighting assembly. The rail assembly includes at least one mounting bracket, a rail and a spring. The rail is pivotable relative to the at least one mounting bracket. To insert the lighting fixture into the ceiling grid, the rail is rotated relative to the mounting bracket such that the rail will clear the ceiling grid, thereby compressing the spring. The lighting fixture is inserted into the ceiling grid and the rail is released. The compression of the spring is relaxed, and the rail rotates back into its original position. The rail, now extending beyond the boundary of the ceiling grid, rests on the ceiling grid is thereby secured within the ceiling grid.

17 Claims, 8 Drawing Sheets

PIVOTABLE RAIL ASSEMBLY FOR INSTALLING RECESSED LIGHTING FIXTURES

CROSS-REFERENCE TO RELATED APPLICATION

This application claims the benefit of U.S. Provisional patent application Ser. No. 61/256,022, filed Oct. 29, 2009, which is incorporated herein by this reference in its entirety.

TECHNICAL FIELD

This invention relates to a pivotable rail assembly for installing recessed lighting fixtures.

BACKGROUND

Suspended mechanical ceilings (i.e., drop ceilings) typically include recessed lighting fixtures that are configured to be flush with the ceiling. These lighting fixtures, commonly referred to as troffer fixtures, are suspended from and secured in the ceiling by a "grid" of t-frames, which also suspend the ceiling tiles in the ceiling.

Ceiling tiles are relatively thin and can be maneuvered into place and installed from below the ceiling. Troffer-type lighting fixtures, however, are comparatively thicker than ceiling tiles and cannot easily be maneuvered into place and installed from below the ceiling. Rather, these lighting fixtures have heretofore been maneuvered "above the grid" and dropped into position from above the ceiling.

Installation work performed "above the grid" is not desirable. Because the lighting fixture must be maneuvered into place above the grid, the depth of the mechanical ceiling may need to be increased to allow adequate maneuvering space. Above the grid installations can also be complicated by nearby obstructions, such as plumbing and HVAC or electrical ducting.

It would thus be desirable for a lighting fixture to be installable from "below the grid."

SUMMARY

A spring-loaded rail assembly for a lighting fixture that includes a rail that is pivotable downwardly as the fixture is inserted up through the ceiling grid opening to thereby create sufficient clearance for the fixture to be installed from "below the grid." The spring tension biases the rail of the rail assembly back to its original, extended position once the fixture is above the grid, and the rail can rest on the ceiling grid to help support the fixture within the ceiling.

The lighting fixture includes a lighting assembly and at least one pivotable rail assembly attached to the lighting assembly for securing the lighting assembly within a ceiling grid. In one embodiment, the at least one rail assembly includes least one mounting bracket, a rail and a spring. The rail is pivotable relative to the at least one mounting bracket.

In certain embodiments the at least one mounting bracket and the rail are formed from sheet metal. In one embodiment, the spring is formed from music wire.

In other embodiments, the at least one rail assembly includes two mounting brackets, and/or the lighting fixture includes two pivotable rail assemblies.

In some embodiments, the at least one mounting bracket, rail and spring may be secured with a fastener, which can be a sheet metal screw.

In yet other embodiments, the lighting assembly is further secured within the ceiling grid by at least one grid clip.

In some embodiments, the lighting assembly is a fluorescent lighting assembly, a light-emitting diode light assembly or an incandescent lighting assembly.

Methods for installing a lighting fixture within a ceiling grid are also provided.

DETAILED DESCRIPTION

One embodiment of the invention includes a spring-loaded rail assembly 10 for a lighting fixture that includes a rail that is pivotable downwardly as the fixture is inserted up through the ceiling grid opening to thereby create sufficient clearance for the fixture to be installed from "below the grid." The spring tension biases the rail of the rail assembly 10 back to its original, extended position once the fixture is above the grid, and the rail can rest on the ceiling grid to help support the fixture within the ceiling.

Figure 1C:
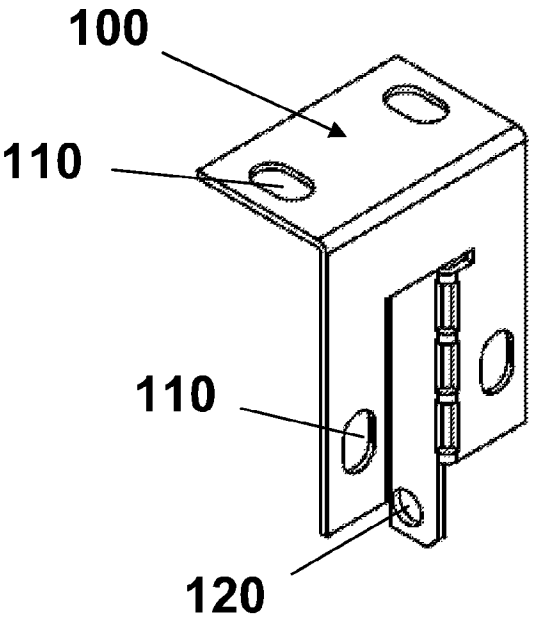
FIG. 1C is a top perspective view of a pivot bracket according to the embodiment of FIG. 1A.
Figure 1B:
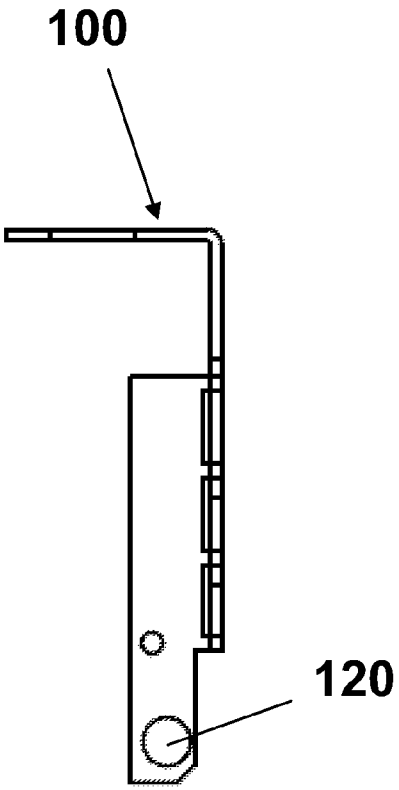
FIG. 1B is an end view of a pivot bracket according to the embodiment of FIG. 1A.
Figure 1A:
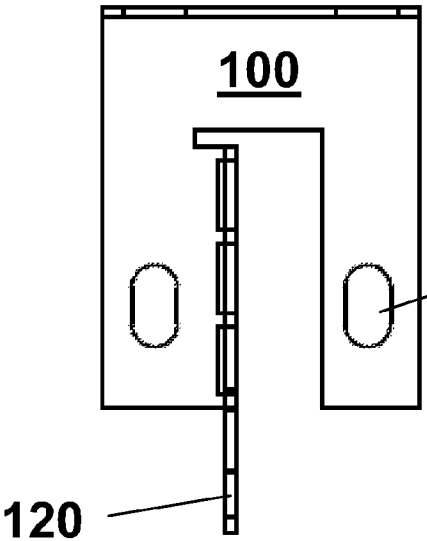
FIG. 1A is a side view of a pivot bracket according to one embodiment of the invention.
Figure 2B:
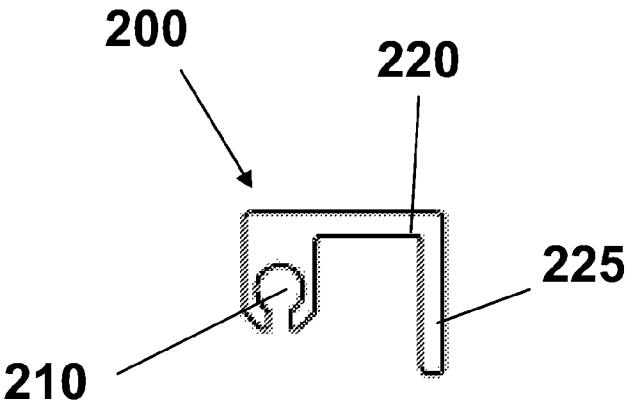
FIG. 2B is an end view of a flange rail according to the embodiment of FIG. 2A.
Figure 2A:
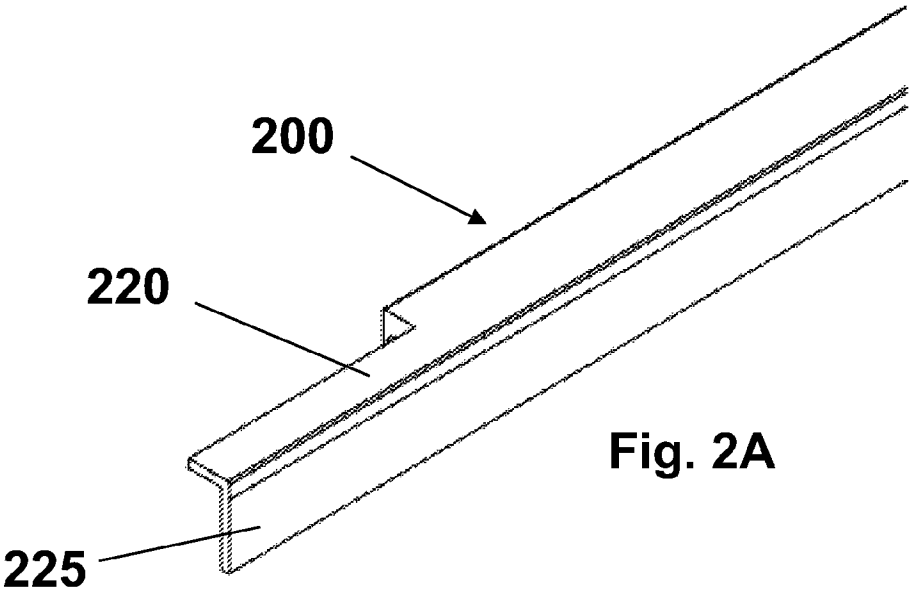
FIG. 2A is a top perspective view of a portion of a flange rail according to one embodiment of the invention.
Figure 2C:
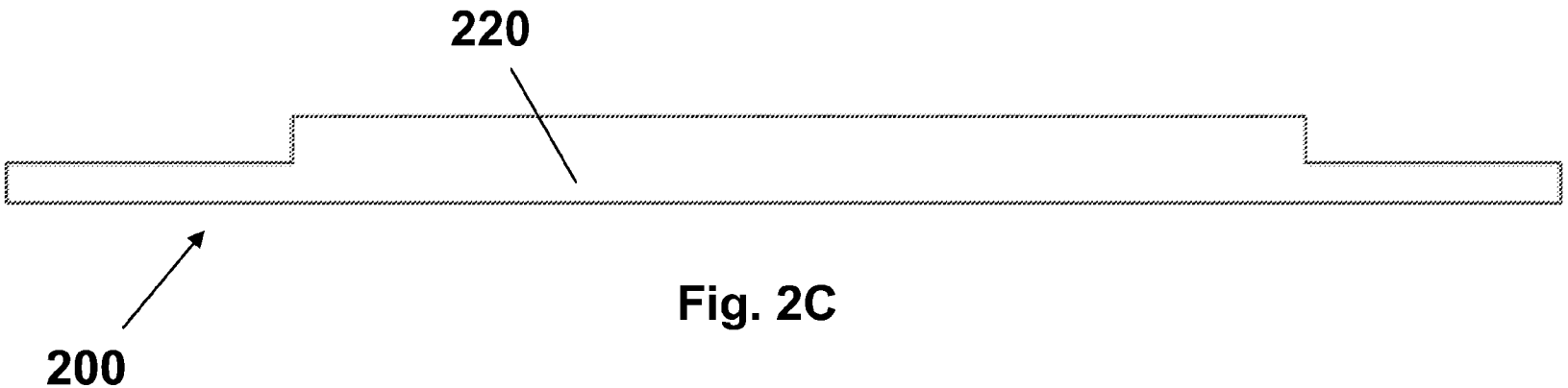
FIG. 2C is a top view of a flange rail according to the embodiment of FIG. 2A.
Figure 4:
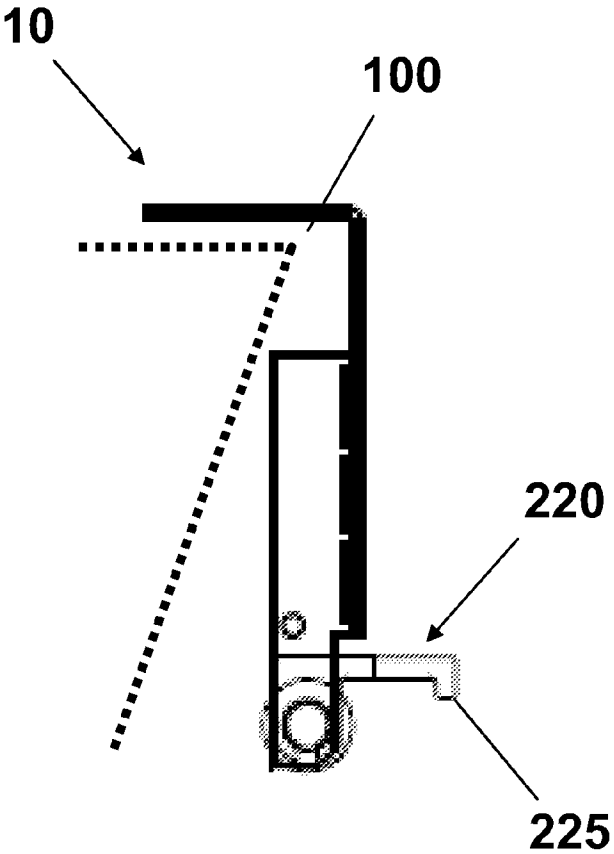
FIG. 4 is an end view of a flange rail assembly according to one embodiment of the invention.
Figure 3A:
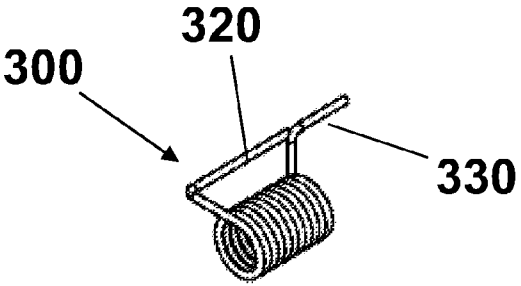
FIG. 3A is a top perspective view of a spring according to one embodiment of the invention.
Figure 3B:
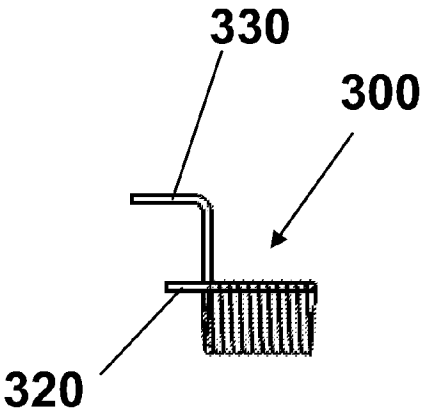
FIG. 3B is a side view of a spring according to the embodiment of FIG. 3A.
Figure 3C:
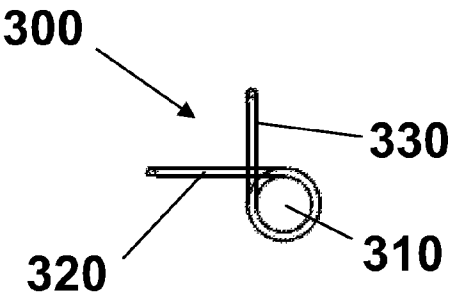
FIG. 3C is an end view of a spring according to the embodiment of FIG. 3A.

With reference to FIGS. 1A-5, the rail assembly 10 includes a mounting bracket 100, a rail 200 and spring 300, which are held together and in place by a pivot screw 500, as discussed below. Spring 300 is tensioned to hold rail 200 in the illustrated, extended position when at rest (i.e., when no external forces are being applied to the rail 200). Several views of an exemplary mounting bracket 100 are provided in FIGS. 1A-1C, views of an exemplary rail 200 are provided in FIGS. 2A-2C, and views of an exemplary spring 300 are provided in FIGS. 3A-3C. FIGS. 4, 5A and 5B show mounting bracket 100 attached to rail 200 with spring 300 and pivot screw 500.

Mounting bracket 100 and rail 200 can be formed from suitable materials for use in lighting fixture applications, including but not limited to aluminum and other metals and their alloys and plastic. Pivot screw 500 can be formed from suitable fastener materials, such as aluminum and/or steel and their alloys. In one embodiment, pivot screw 500 is a sheet metal screw. Spring 300 can be formed from suitable torsion coil spring materials including but not limited to steel alloys (such as carbon alloys, chrome silicon, chrome vanadium, and stainless steel), beryllium copper alloy, phosphor bronze, and titanium. In one embodiment, the spring is formed from high carbon steel (e.g., music wire).

Figure 5A:
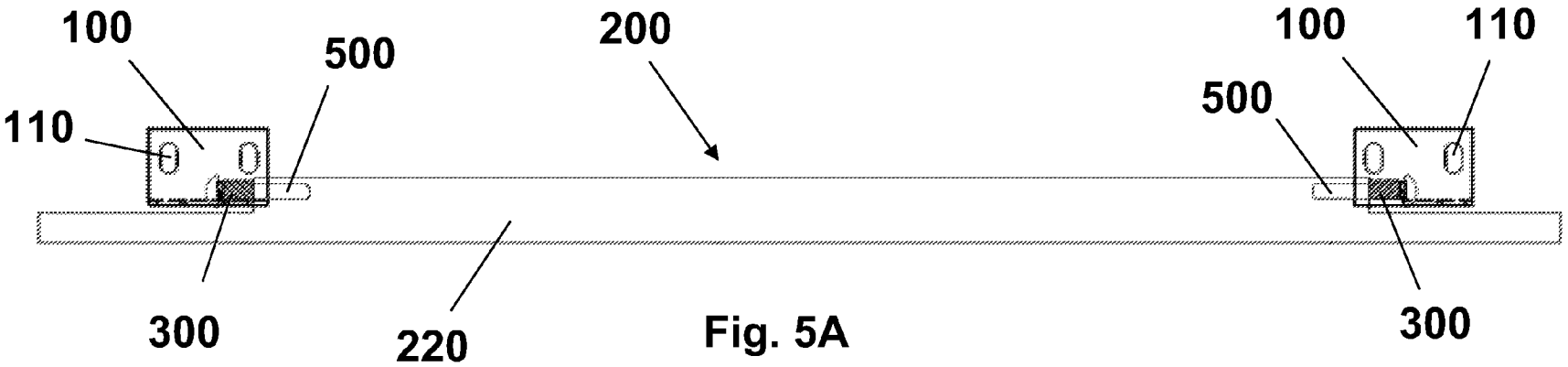
FIG. 5A is a top view of a flange rail assembly according to an embodiment of the invention.
Figure 5B:
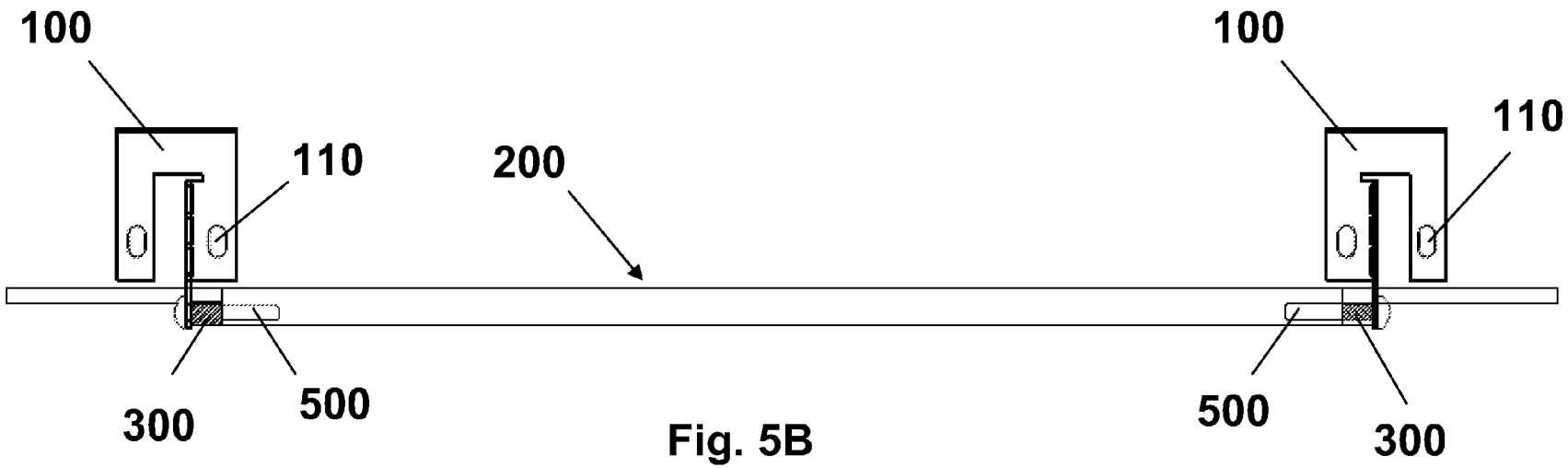
FIG. 5B is a side view of the flange rail assembly according to the embodiment of FIG. 5A.

In one embodiment, a rail assembly 10 is affixed to a side of a lighting fixture by attaching a pair of mounting brackets 100 to the outside of the fixture with a fastener such as a screw inserted through one or more mounting holes 110 in the mounting bracket 100. Each end of a rail 200 is attached to the one of the mounting brackets 100 with a spring 300 and pivot screw 500. The mounting bracket 100 has a screw hole 120, and each end of the rail 200 has a screw hole 210 for receiving the pivot screw 500 and holding the spring 300 in place. To assemble the rail assembly 10, the pivot screw 500 is inserted into the screw hole 120 in the mounting bracket 100. A spring 300 is inserted over the pivot screw 500 through a central aperture 310 of the spring 300. The screw hole 210 on the rail 200 is lined up with the pivot screw 500, and the pivot screw 500 is securely fastened into the screw hole 210 on the rail 200. In this manner, as illustrated in FIGS. 5A and 5B, the spring 300 is secured between the screw hole 120 in the mounting bracket 100 and the screw hole 210 in the rail 200.

The spring 300 has two ends 320, 330 and is configured such that one of the ends (e.g., 320) is biased against the mounting bracket 100 and the other end (e.g., 330) is biased against the rail 200. The spring 300 is thus configured such that manually rotating the rail 200 about the pivot screw 500 compresses the spring 300, and releasing the spring 300 relaxes the compression of the spring 300, causing the rail 200 to rotate back into its original position. It will be understood that if a rail 200 includes two mounting brackets 100 (one on each end of the rail 200), it may be desirable or necessary to provide mounting brackets 100 and springs 300 that are mirror images of each other, as a clockwise rotation of the rail 200 on one side of the rail assembly 10 corresponds to a counterclockwise rotation of the rail 200 on the other side of the rail assembly 10. Moreover, while the rail assembly 10 is described as having a pivot screw 500, it will be recognized that other types of fasteners, such as a nut and bolt, could be used to connect the mounting bracket 100, rail 200 and spring 300.

The spring 300 is configured and arranged in the rail assembly 10 to bias rail 200 in the extended position illustrated in FIG. 4 (i.e., with flange 220 of the rail 200 extending generally outwardly from the rail assembly 10) so that the flange 220 of the rail 200 can rest on the t-frame of the ceiling grid to thereby support the lighting fixture within the ceiling grid. When the flange 220 of the rail 200 is manually rotated downwardly (so that the assembly 10 will fit between the t-frames of the ceiling grid, as described below), the spring 300 is placed under tension.

To describe the operation of the rail assembly 10 in more detail, when the lighting fixture having at least one rail assembly 10 mounted thereon is to be installed, the flange 220 of the flange rail 200 is rotated downwardly. The downward rotation of the flange 220 provides sufficient clearance for the lighting fixture to be inserted into the ceiling grid. When the lighting fixture has cleared the ceiling grid, the flange 220 is released. The spring 300 causes the flange 220 to rotate back into its "resting" position. The lighting fixture is thus held in place at least in part by engagement of the flange 220 with the t-frame of the ceiling grid. With reference to FIGS. 2A, 2B, 4 and 7, it will be evident that a portion 225 of flange 220 extends downwardly from the flange 220 when the flange 220 is in its resting position. The length of this portion 225 determines the position of the light fixture relative to the face of the ceiling (since the fixture rests on the t-frame of the ceiling grid on this portion 225), and it will be recognized that the length of this portion 225 can be adjusted for different configurations.

Figure 6A:
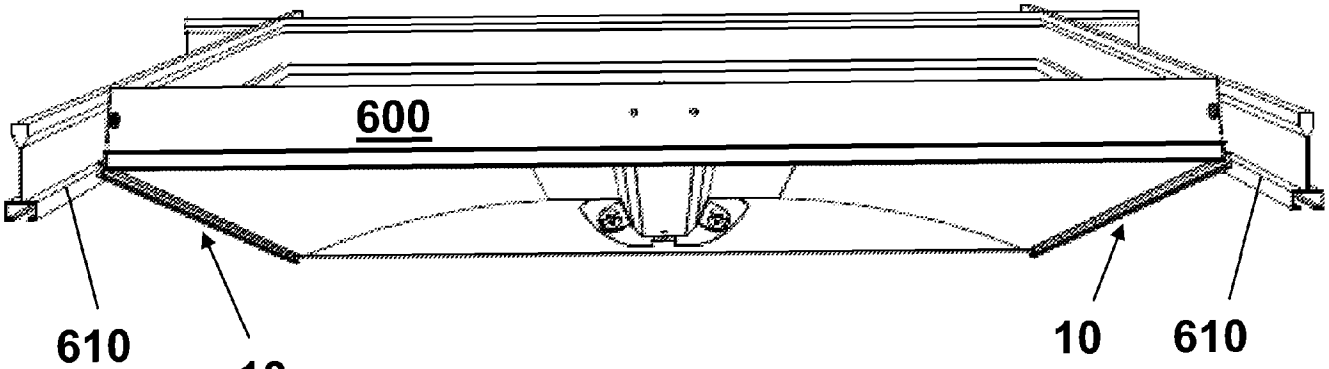
FIG. 6A is an end view of a lighting fixture according to one embodiment of the invention.
Figure 6B:
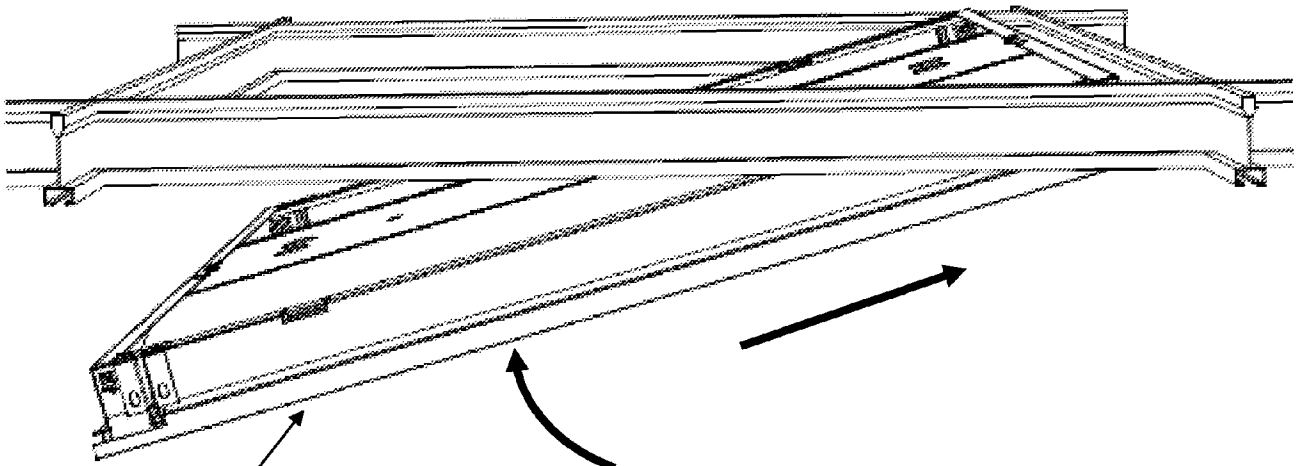
FIG. 6B is a side view of a lighting fixture according to an embodiment of the invention.
Figure 6C:
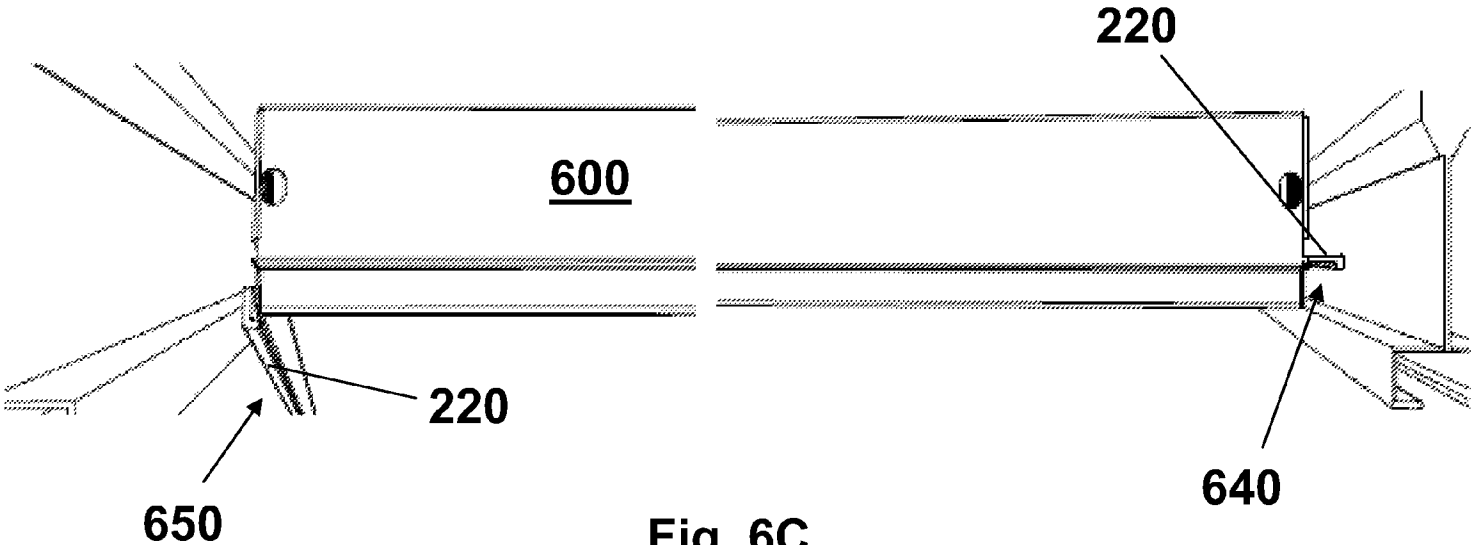
FIG. 6C is an end view of a portion of a lighting fixture according to one embodiment of the invention.
Figure 6D:
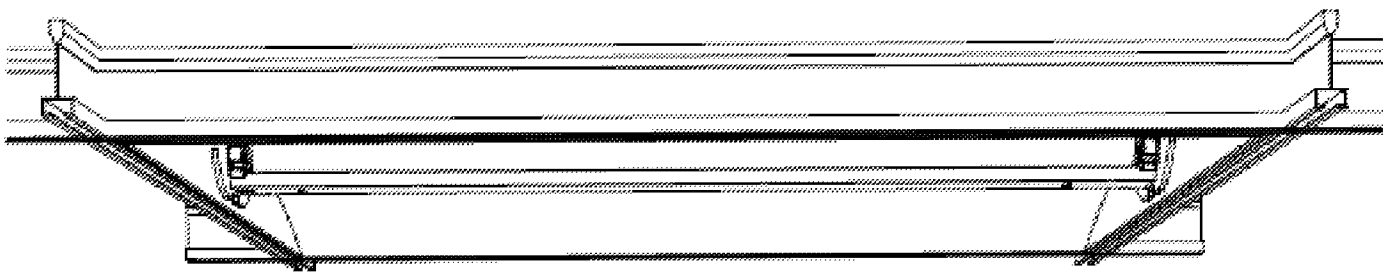
FIG. 6D is a side view of a lighting fixture according to an embodiment of the invention.

Embodiments of this operation are illustrated in exemplary FIGS. 6A-6D. FIG. 6A illustrates an end view of a lighting fixture having two rail assemblies 10 attached at opposite ends of a lighting fixture 600 (installed parallel to the lamps). FIG. 6B illustrates a side view of this fixture. FIG. 6C shows the fixture with the flange 220 of one rail 200 in its extended position 640 and the flange 220 of the other rail 200 in is depressed position 650. FIG. 6D shows the lighting fixture installed in the ceiling grid. As illustrated in FIGS. 6A and 6B, with both rail assemblies 10 in their depressed positions, the lighting fixture can be installed by tilting the fixture into the grid and adjusting the fixture so that the flanges 220 of the rails 200 are above the t-frame of the ceiling grid 610. With the fixture slightly raised above the t-frame 610, the flanges 220 are then released so that they pivot back to their extended positions by action of the spring 300 and can rest on the t-frame 610 to help retain the fixture within the ceiling.

Although the lighting fixture is described above as having two rail assemblies 10 installed thereon (on opposite sides of the fixture), it will be understood that only one rail assembly 10 or more than two rail assemblies 10 could be installed on the fixture. In addition, the rail assembly on one side of the fixture could be split into two or more components if desired for ease of machining or for other considerations. In other words, two separate rail assemblies could be installed on one side (or more than one side) of the lighting fixture.

Figure 7:
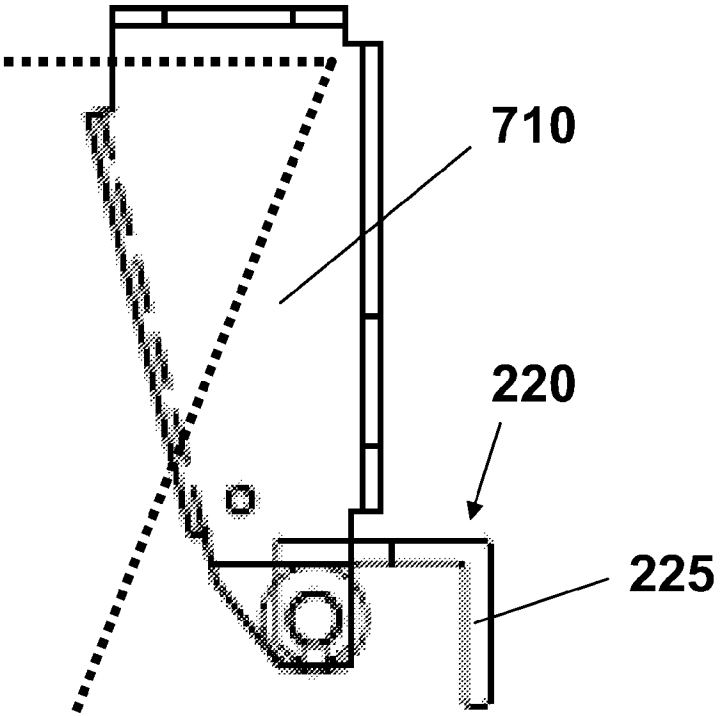
FIG. 7 is an end view of a flange rail assembly according to an embodiment of the invention.

An alternative embodiment of a mounting bracket 710 is illustrated in FIG. 7.

The rails 200 and other components of the rail assembly 10 described herein can be sized for different types of grid constructions, such as "slot grid" or "inverted T-grid" constructions. It will be understood by a person skilled in the art that the rail and other components of the embodiments described herein can be appropriately sized and shaped for other types of grid constructions.

Figure 8:
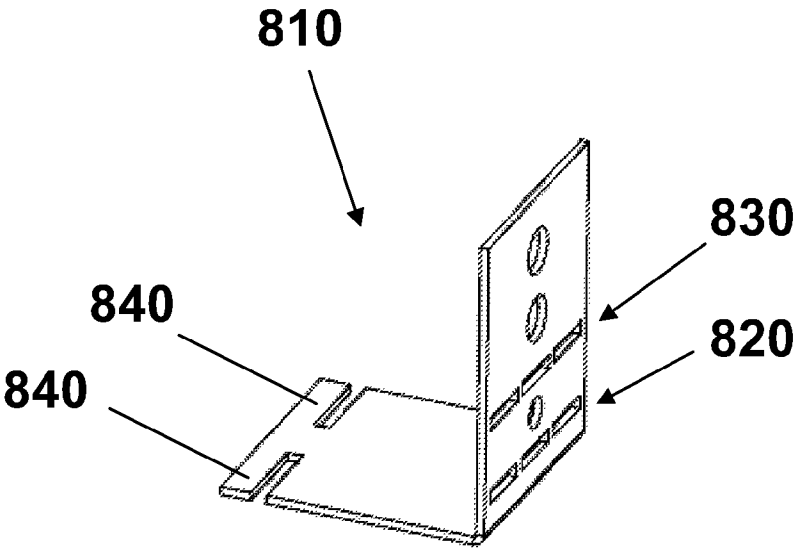
FIG. 8 is a top perspective view of a grid clip according to one embodiment of the invention.
Figure 9:
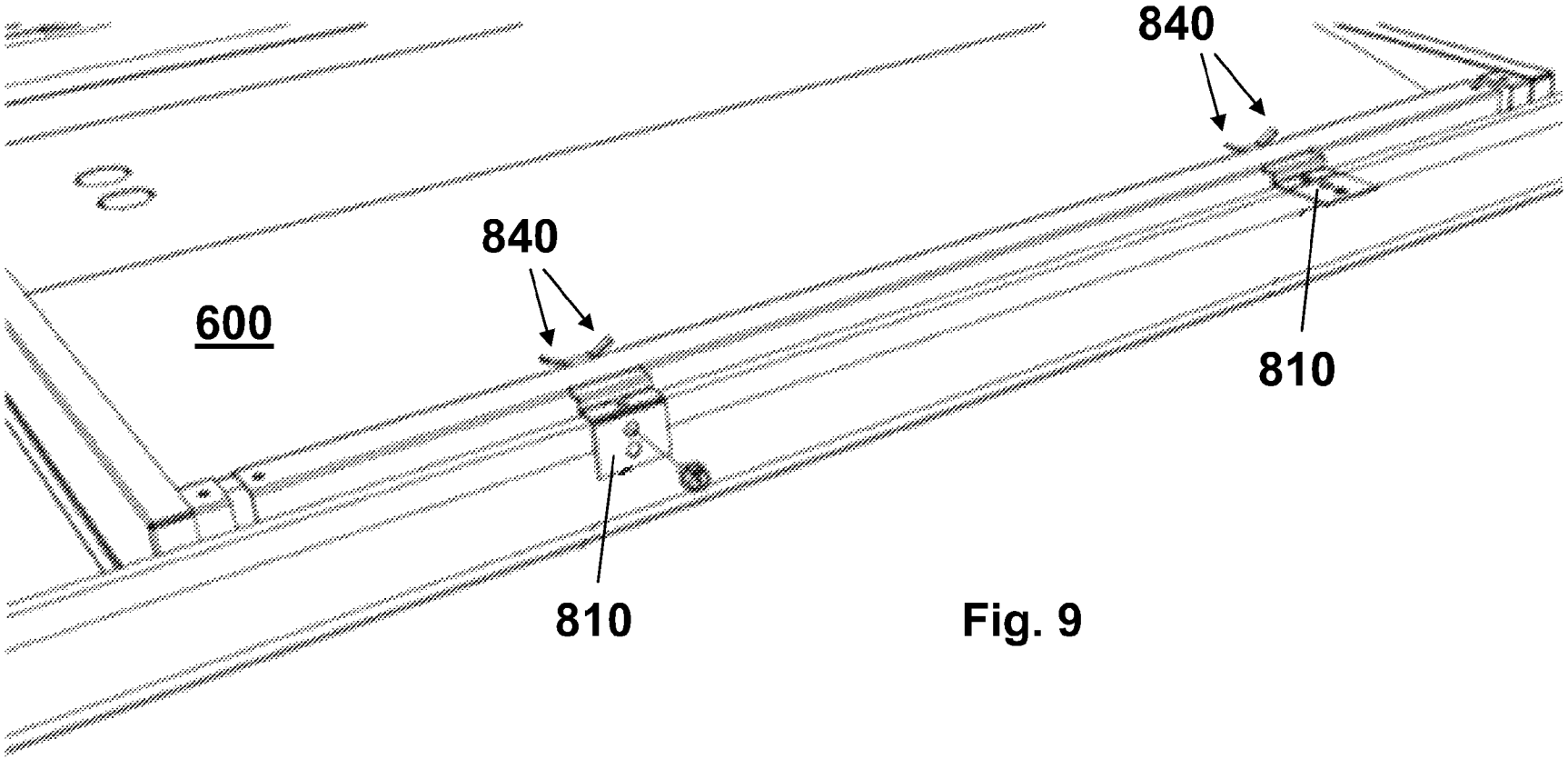
FIG. 9 is a top perspective view of a portion of a lighting fixture with grid clips according to an embodiment of the invention.

In certain embodiments, it may be desirable to secure the lighting fixture to the ceiling grid with one or more grid clips to more securely hold the lighting fixture in place. Such a configuration is particularly desirable—and in fact may be required such as by local building codes—in geographical areas prone to earthquakes. Accordingly, if desired one or more grid clips 810 as shown in FIG. 8 may be provided. The grid clip 810 may be packaged with the lighting fixture. The grid clips 810 are removed from the fixture prior to installation and then manually installed after installation of the fixture in the ceiling grid. The clips can be manually formed by bending each clip at 820 and 830, inserting one end of the clip 810 into slots in the lighting fixture (see FIG. 9), and then affixing the clip to the ceiling grid with a fastener. Wings 840 may be bent upward to prevent the grid clip 810 from separating from the lighting fixture. Obviously, other configurations of grid clips 810 would be known to one of skill in the art and within the scope of this disclosure.

An exemplary lighting fixture for use with embodiments of the invention as described herein is a fluorescent lighting troffer. Alternative lighting fixture designs include light emitting diode (LED) fixtures and incandescent fixtures.

The embodiments described herein allow a lighting fixture to be installed from below the ceiling, which may also allow for decreased ceiling depth since the need for maneuvering room above the ceiling grid is eliminated. In addition, fixtures equipped with embodiments of the invention described herein can be installed anywhere that ceiling obstructions complicate or prevent traditional "above the grid" fixture installations.

The foregoing is provided for the purpose of illustrating, explaining and describing embodiments of the present invention. Further modifications and adaptations to these embodiments will be apparent to those skilled in the art and may be made without departing from the spirit of the invention or the scope of the claims. Moreover, all aspects of the invention need not necessarily be practiced in every embodiment of the invention.

We claim:

1. A lighting fixture comprising:

a lighting assembly, the lighting assembly including a frame and a light source;

at least one bracket attached to the frame, the at least one bracket comprising a spring, and at least one rail assembly pivotally attached to the bracket securing the lighting assembly within a ceiling grid, wherein the at least one bracket retains the rail assembly in a first position retaining the lighting assembly in the ceiling grid, and wherein the rail assembly is pivotable from the first position to a second position for installation of the lighting assembly into the ceiling grid.

2. The lighting fixture of claim 1, wherein the at least one bracket and the rail assembly are formed from sheet metal.

3. The lighting fixture of claim 1, wherein the spring comprises music wire.

4. The lighting fixture of claim 1, wherein the lighting assembly comprises two brackets and one rail assembly attached to the two brackets.

5. The lighting fixture of claim 1, wherein the lighting fixture comprises two rail assemblies and each rail assembly is attached to the frame by two brackets.

6. The lighting fixture of claim 1, wherein the at least one bracket, rail assembly and spring are secured with a fastener.

7. The lighting fixture of claim 6, wherein the fastener is a sheet metal screw.

8. The lighting fixture of claim 1, wherein the lighting assembly is further secured within the ceiling grid by at least one grid clip.

9. The lighting fixture of claim 1, wherein the lighting assembly is a fluorescent lighting assembly, a light-emitting diode light assembly or an incandescent lighting assembly.

10. A method of installing a lighting fixture within a ceiling grid, wherein the lighting fixture comprises:

a lighting assembly including a frame and a light source;

at least one bracket attached to the frame, the at least one bracket including a spring; and at least one rail assembly attached to the bracket, the at least one rail assembly including a rail, the method comprising:

rotating the rail of the rail assembly from a first position to a second position, thereby compressing the spring;

inserting the lighting assembly into the ceiling grid such that the rail is above the ceiling grid; and releasing the rail such that the compression of the spring relaxes and causes the rail to rotate from the second position to the first position, thereby securing the lighting assembly within the ceiling grid.

11. The method of claim 10, wherein the at least one bracket and the rail are formed from sheet metal.

12. The method of claim 10, wherein the spring is formed from music wire.

13. The method of claim 10, wherein the lighting assembly comprises two brackets and one rail assembly attached to the two brackets.

14. The method of claim 13, wherein the lighting fixture comprises two rail assemblies and each rail assembly is attached to the frame by two brackets.

15. The method of claim 10, wherein the at least one bracket, rail and spring are secured with a fastener.

16. The method of claim 15, wherein the fastener is a sheet metal screw.

17. The method of claim 10, further comprising further securing the lighting assembly within the ceiling grid by at least one grid clip.

* * * * *